US009214103B2

(12) United States Patent
Mancuso

(10) Patent No.: US 9,214,103 B2
(45) Date of Patent: Dec. 15, 2015

(54) MODULAR SIGN SYSTEM

(76) Inventor: Salvatore Patrick Mancuso, Houston, TX (US)

( * ) Notice: Subject to any disclaimer, the term of this patent is extended or adjusted under 35 U.S.C. 154(b) by 717 days.

(21) Appl. No.: 13/289,323

(22) Filed: Nov. 4, 2011

(65) Prior Publication Data

US 2012/0047783 A1 Mar. 1, 2012

Related U.S. Application Data

(63) Continuation of application No. 11/688,572, filed on Mar. 20, 2007, now Pat. No. 8,074,387.

(51) Int. Cl.
*G09F 13/04* (2006.01)
*G09F 13/22* (2006.01)

(52) U.S. Cl.
CPC ..... *G09F 13/22* (2013.01); *G09F 13/04* (2013.01); *Y10T 29/49826* (2015.01); *Y10T 403/14* (2015.01)

(58) Field of Classification Search
USPC ..... 40/564, 606.01, 781, 605, 584, 607.13, 40/570; 248/473, 488; 406/6; 52/656.1, 52/287.1, 288.1; 220/4.21, 4.24
See application file for complete search history.

(56) References Cited

U.S. PATENT DOCUMENTS

| | | | | | |
|---|---|---|---|---|---|
| 1,598,438 | A | | 8/1926 | Hallowell | |
| 2,181,150 | A | * | 11/1939 | Pittenger | 220/265 |
| 2,197,481 | A | | 4/1940 | Nyden | |
| 2,219,487 | A | * | 10/1940 | Nyden | 206/534.2 |
| 3,003,658 | A | | 10/1961 | Lindsey | |
| 3,782,015 | A | | 1/1974 | Esry | |
| 3,977,111 | A | | 8/1976 | Fritts | |
| 4,098,430 | A | | 7/1978 | Mattheis et al. | |
| 4,587,753 | A | | 5/1986 | Harper | |
| 4,848,017 | A | * | 7/1989 | Bailey et al. | 40/576 |
| 4,912,863 | A | * | 4/1990 | Harvey | 40/730 |
| 5,369,549 | A | | 11/1994 | Kopp et al. | |
| 5,379,540 | A | | 1/1995 | Howard | |
| 5,523,930 | A | | 6/1996 | Fritts | |
| 6,042,243 | A | | 3/2000 | Grill et al. | |
| 6,042,248 | A | * | 3/2000 | Hannah et al. | 362/235 |
| 6,050,013 | A | | 4/2000 | Heaton et al. | |
| 6,082,031 | A | | 7/2000 | Hearton et al. | |
| 6,314,688 | B1 | | 11/2001 | Ford et al. | |
| 6,557,283 | B1 | | 5/2003 | Canfield | |

* cited by examiner

*Primary Examiner* — Syed A Islam
(74) *Attorney, Agent, or Firm* — Blank Rome LLP

(57) ABSTRACT

A sign system comprises one or more box-like modules having a front section and a corresponding rear section sized to fit together in sliding engagement to define an interior cavity. The sections may be joined together with fasteners which engage the side panels of each section thereby leaving the front and rear surfaces free of discontinuities. The sign modules may be affixed to a generally planar surface or supported on internal or external mounting posts. During installation, the rear section may be mounted first and the front section subsequently attached to the rear section. In this way only approximately one-half of the total weight of the sign need be lifted and manipulated at any one time thereby facilitating installation. The interior cavity defined by the front and rear sections may accommodate lighting means for internally lighting the sign.

18 Claims, 6 Drawing Sheets

MODULAR SIGN SYSTEM

CROSS-REFERENCE TO RELATED APPLICATIONS

This application is a continuation of U.S. patent application Ser. No. 11/688,572 filed Mar. 20, 2007.

STATEMENT REGARDING FEDERALLY SPONSORED RESEARCH OR DEVELOPMENT

Not Applicable

BACKGROUND OF THE INVENTION

1. Field of the Invention

This invention relates to display signs. More particularly, it relates to multi-part signs specially adapted for ease of installation.

2. Description of the Related Art Including Information Disclosed Under 37 CFR 1.97 and 1.98

Many signs and sign systems are described in the prior art. In general, a sign comprises a display surface suitable for receiving the application of a graphic or alphanumeric message. In some exemplars, the sign itself may form the message—e.g., a sign whose three-dimensional shape comprises the message.

U.S. Pat. No. 5,379,540 describes a sign assembly that can be formed by attaching several modules together. Each module includes a lamp assembly for backlighting the sign display, and has walls with a plurality of dovetail grooves in their exterior surfaces. Double dovetail unions engage the dovetail grooves in abutting walls of a pair of modules to fasten those modules together. Other dovetail unions fill in exposed grooves or fasten a frame around the perimeter of the sign assembly. Each module has a wiring assembly with connectors at each corner so that adjoining modules can be electrically interconnected.

A modular light box is described in U.S. Pat. No. 6,042,243 to James Grill et al. The light box comprises a rectangular frame defining an enclosure and a front rectangular opening. The frame is formed of a pair of side panels, a bottom panel and a top panel, each of which is provided with a substantially flat, rectangular outer surface and an electrical wiring port extending from within the enclosure out through an opening in the outer surface of the panel. A translucent display panel is mounted within the opening defined by the frame. Another such display panel may be mounted in the rear opening in the frame. One or more lamps are mounted within the enclosure to provide backlighting for the front, and optionally the rear, display panel. One or more of the panels forming the frame of the modular light box may be constructed with a rectangular core of foamed plastic having a rigid support frame about its periphery and a plastic layer adhered to each of the major surfaces thereof.

Displays backlit with fluorescent lights are described in U.S. Pat. No. 5,523,930 to Robert Fritts. The displays have a generally planar light transmissive display panel, a back wall having a generally planar diffusely reflective surface facing, spaced from and parallel with the display panel, an array of spaced parallel cylindrical lamps between and parallel with the display panel and back wall, light leveling means including masking means on the side of each lamp facing the display panel, and a light spreader associated with each lamp at the diffusely reflective back wall surface. The display is of modular construction and employs a rectangular supporting frame on the front of which the display panel is mounted and in which modular lighting units are removably accommodated in side by side abutting relation. Sectional lighting unit trays may be used to facilitate handling and shipping.

BRIEF SUMMARY OF THE INVENTION

A sign according to one embodiment of the invention has an anterior piece with a generally planar surface suitable for messages or advertising display surrounded by a generally orthogonal periphery of uniform depth. A posterior piece is similarly configured with a generally planar surface suitable for mounting to a supporting structure and a generally orthogonal periphery sized to fit within the peripheral element of the anterior piece in sliding engagement. When assembled, the sign has an interior cavity which may accommodate illumination means, support means, or the like.

A sign fabricated in accordance with the present invention may be conveniently installed in a two-step process. First, the posterior piece is mounted to a suitable support. Next, the anterior piece is fitted over the corresponding posterior piece and secured to it. In this way only approximately one-half of the full weight of the sign or sign module need be lifted and manipulated at any one time during installation. An additional advantage of a design according to the present invention is that the anterior piece may be secured to the posterior piece by means of fasteners which engage the peripheral portions of each section. In this way, the front, display surface of the sign may be free of fasteners and hence present an entirely flat and consistent surface to receive the message or advertising display.

BRIEF DESCRIPTION OF THE SEVERAL VIEWS OF THE DRAWING(S)

FIG. 2A is an enlarged view of one corner of the sign illustrated in FIG. 2.

DETAILED DESCRIPTION OF THE INVENTION

The invention may best be understood by reference to exemplary embodiments.

Figure 1A:
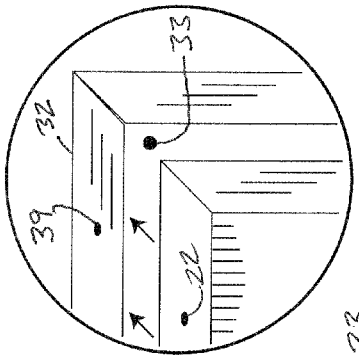
FIG. 1A is an enlarged view of one corner of the embodiment shown in FIG. 1.
Figure 1:
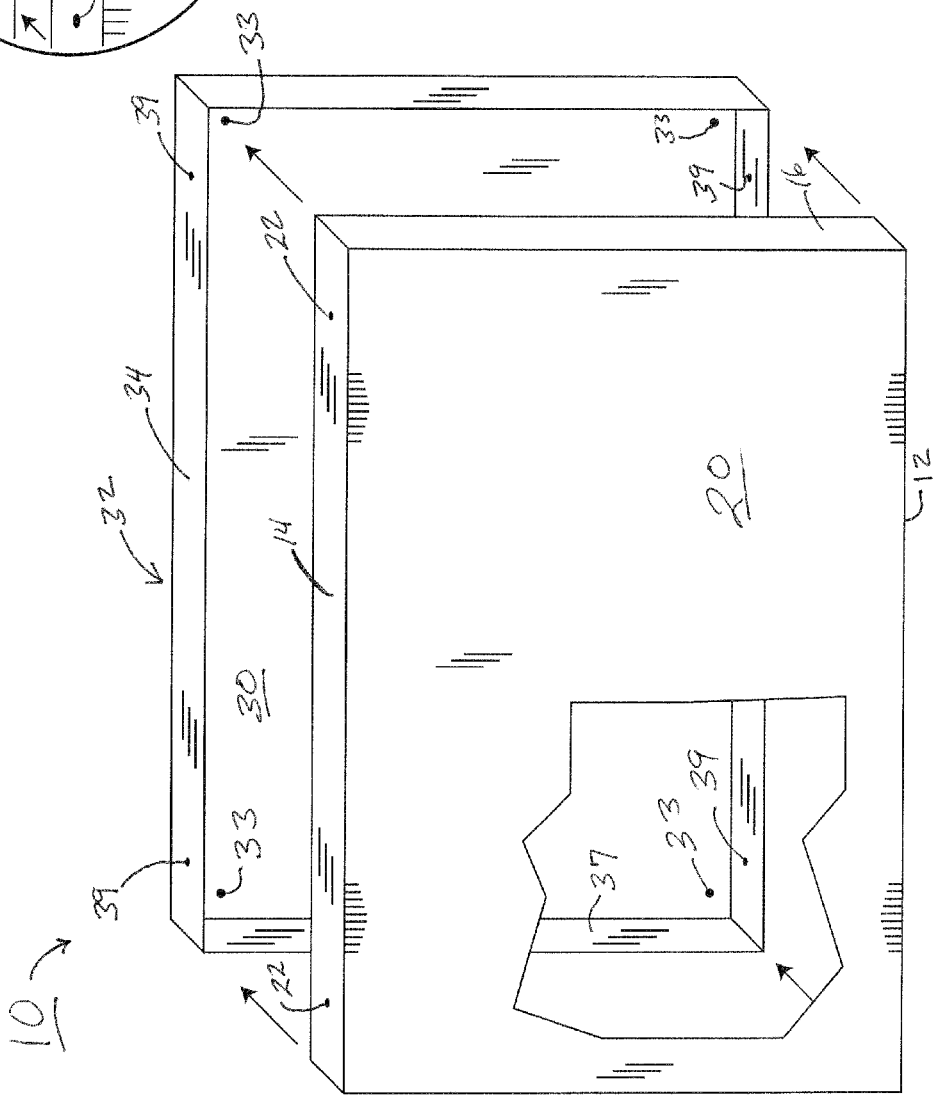
FIG. 1 is an exploded, partially cutaway, perspective view of a first embodiment.

FIG. 1 shows a sign system 10 according to a first embodiment of the invention. The signboard is comprised of front or anterior member 12 and rear or posterior member 32. Front member 12 comprises generally planar surface 20, top side panel 14 and right side panel 16. The bottom side panel (not visible in the perspective view of FIG. 1) may be a mirror image of top panel 14 and the left side panel (also not shown) may be a mirror image of right panel 16. In one particular preferred embodiment, front member 12 is fabricated from sheet metal and side panels 16 and top and bottom panels 14 are formed by making 90.degree. bends in the metal sheet.

Rear member 32 is configured in a similar fashion to front member 12. Rear member 32 may comprise generally planar rear surface 30, top side panel 34, bottom side panel 36, right side panel 35 and left side panel 37. The side panels are generally orthogonal to rear surface 30. Top panel 34 and bottom panel 36 may be equipped with fastener holes 39 which align with fastener holes 22 in top (and bottom) panel 14 of front member 12 when the sign board is assembled. Mounting holes 33 may be provided in rear panel 30 for securing rear member 32 to a generally flat surface—e.g., the facade of a building.

Front member 12 and rear member 32 may be sized and configured to fit together in the manner of a gift box with rear member 32 being analogous to the bottom of the box and front member 12 being analogous to the lid of the box. In certain embodiments, the corners may be reinforced to provide additional strength and rigidity and to seal the joint between side panels from the elements. One example of such a reinforcement is an L-shaped member which may be cemented or otherwise fastened to the interior joint between, e.g., a side panel and a top or bottom edge panel.

When front member 12 is engaged with rear member 32, it may be secured by means of fasteners which pass through holes 22 and into holes 39 in top and bottom edge panels 34 and 36, respectively. It will be understood that front member 12 may have a bottom edge panel which corresponds to top edge panel 14 and said bottom edge panel may likewise be equipped with holes or openings through which fastener means may engage holes 39 in bottom panel 36 of rear member 32. Rear section 32 may first be secured to a supporting surface by means of fasteners which pass through holes 33 in surface 30. Front section 12 may then subsequently be mated with and secured to rear section 32. In this way, only about one-half the total weight of sign system 10 needs to be lifted and manipulated at any one time during installation. This feature of the present invention which provides ease of installation is a significant advantage over the sign systems of the prior art.

Front member 12 and rear member 32 may be fabricated of any suitable material. Examples include, but are not limited to, sheet metal, machined metal, plastics (e.g., LEXAN®, Plexiglas, polyvinylchloride, CENTRA™ expanded PVC) fiberglass and other composites, wood and wood composites, foam core board and corrugated board. Front member 12 may be fabricated from the same or different material as rear member 32.

Figure 2:
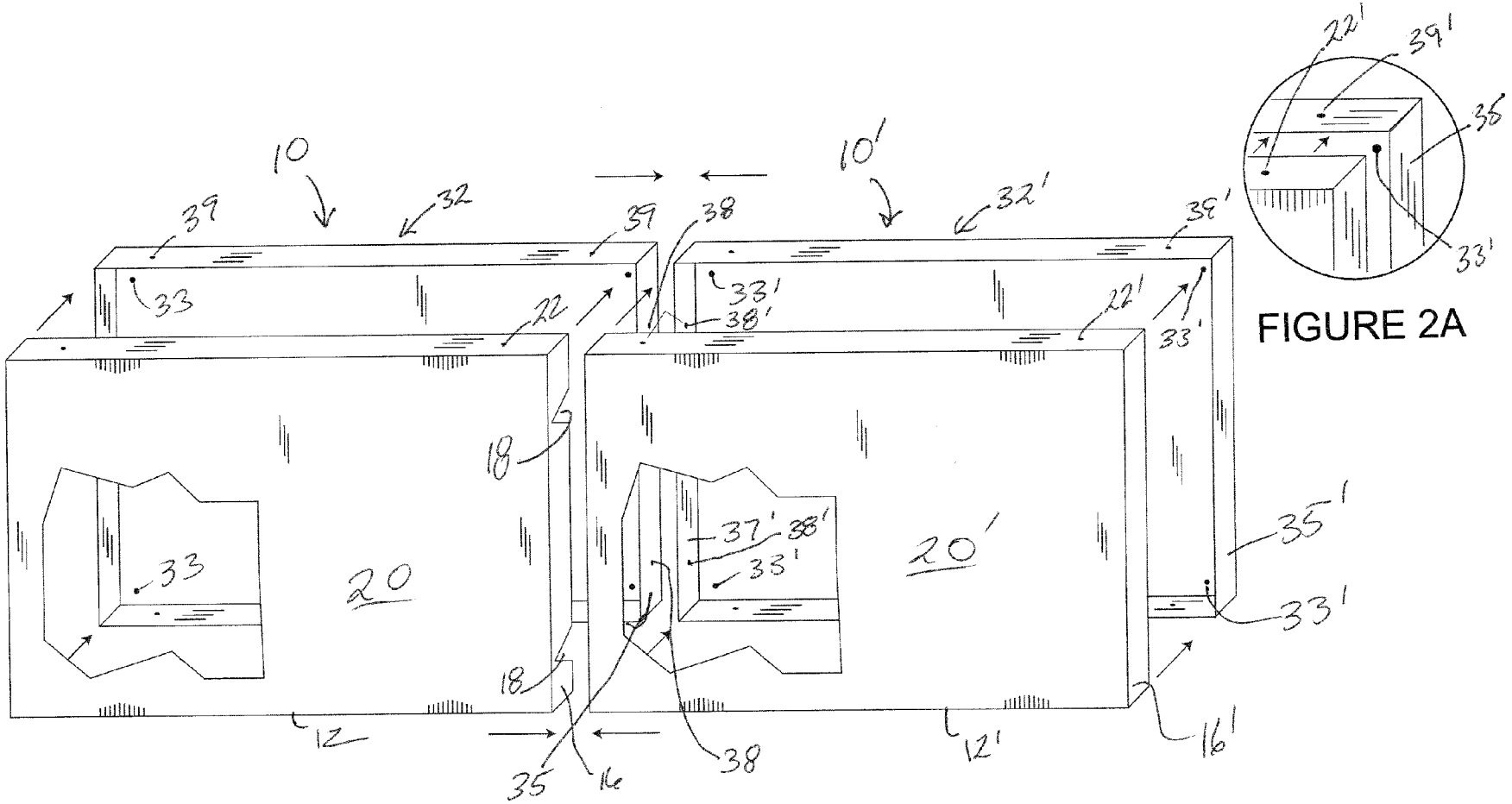
FIG. 2 is an exploded, partially cutaway, perspective view of a sign comprised of two modules according to the first embodiment.

FIG. 2 shows how two sign modules 10 and 10' according to the embodiment illustrated in FIG. 1 may be combined to provide a sign with a larger display surface 20+20'. Rear members 32 and 32' may be joined together by means of fasteners which pass through holes 38 and 38'. Slots or notches 18 in side 16 of front member 12 and side 37' of front member 12' (not shown) may be provided in order to avoid interference with the fasteners joining the two modules (at holes 38). It will be appreciated that sign modules according to the embodiment of FIG. 1 may also be joined together vertically and an unlimited number of modules may be joined horizontally, vertically, or both horizontally and vertically—e.g., a 2-by-2, 4-module sign.

Figure 3:
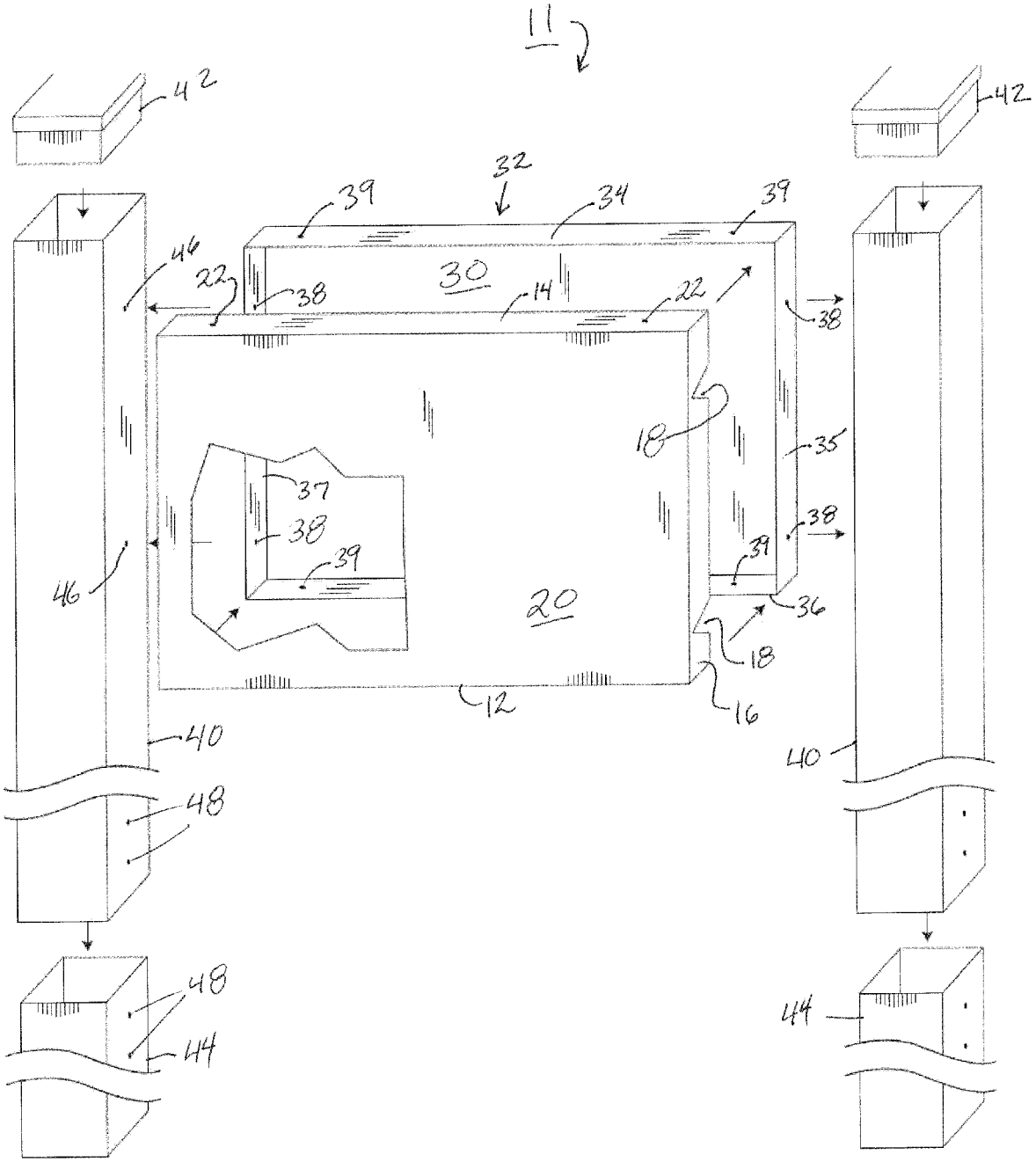
FIG. 3 is an exploded, partially cutaway, perspective view of a sign according to the first embodiment adapted for use with external mounting posts.

FIG. 3 illustrates a sign system 11 according to the embodiment of the invention illustrated in FIG. 1 that is adapted for use with an opposed pair of external, generally rectangular mounting posts 40. Left and right mounting posts or stanchions 40 may be fabricated of any suitable material—examples of which include sheet metal, metal extrusions, plastics, fiberglass and other composites, wood and wood composites, and concrete. In the illustrated embodiment, support posts 40 are hollow and may be fitted with insertable caps 42 to prevent debris and rainwater from entering the central cavity from above. Support posts 40 may comprise one or more sections. In the illustrated embodiment, upper section 40 joins lower section 44 in sliding engagement. Section joining attachment holes 48 may be provided for securing the sections together. A number of suitable fastening means are well known in the art. Examples include bolts, sheet metal screws, rivets, and the like. In one particular preferred embodiment, upper section 40 is provided with an interior cavity which accommodates the cross section of lower segment 44 in an interference fit such that, when assembled, upper section 40 overlaps lower section 44 and rainwater is shed without entering the joint between the two sections.

Side panels 35 and 37 may be provided with mounting holes 38 for accommodating fasteners used to secure rear member 32 to supports 40. In practice, rear member 32 may be secured to supports 40 by means of fasteners which pass through holes or openings 38 in side panels 35 and 37. Particularly preferred are fasteners which provide a space between side panels 35 and 37 and the opposing surfaces of supports 40 sufficient to permit side panel 16 of front member 12 to slide between side panel 35 (or 37) and mounting support 40. Slots or notches 18 in side panel 16 are provided to enable front member 12 to mate with rear member 32 in sliding engagement without interference with fastening means extending through holes 38.

It should be appreciated that front member 12 and rear member 32 each have a generally planar surface (20 and 30, respectively) suitable for display purposes. Thus, sign system 11 may be two-sided and the same or different displays may be applied to the generally planar surfaces 20 and 30. For purposes of this disclosure, member 12 is considered the front or anterior member inasmuch as it comprises the external edge pieces (14 and 16 and their opposing members) when the signboard is assembled and, in the illustrated embodiments, the exposed edges of the side panels 14 and 16 face away from and are not visible to a viewer observing sign surface 20.

In the illustrated embodiments, the signboard comprised of front 12 and rear 32 is generally rectangular. It will be appreciated, however, that many other shapes may be used in the practice of the invention. Examples include other regular and irregular polygons, circles, ovals, ellipses, alphanumeric shapes and freeform shapes. In general, any shape which may have a generally planar display surface surrounded by a generally orthogonal edge piece at its periphery may be used in the practice of the invention.

Figure 4:
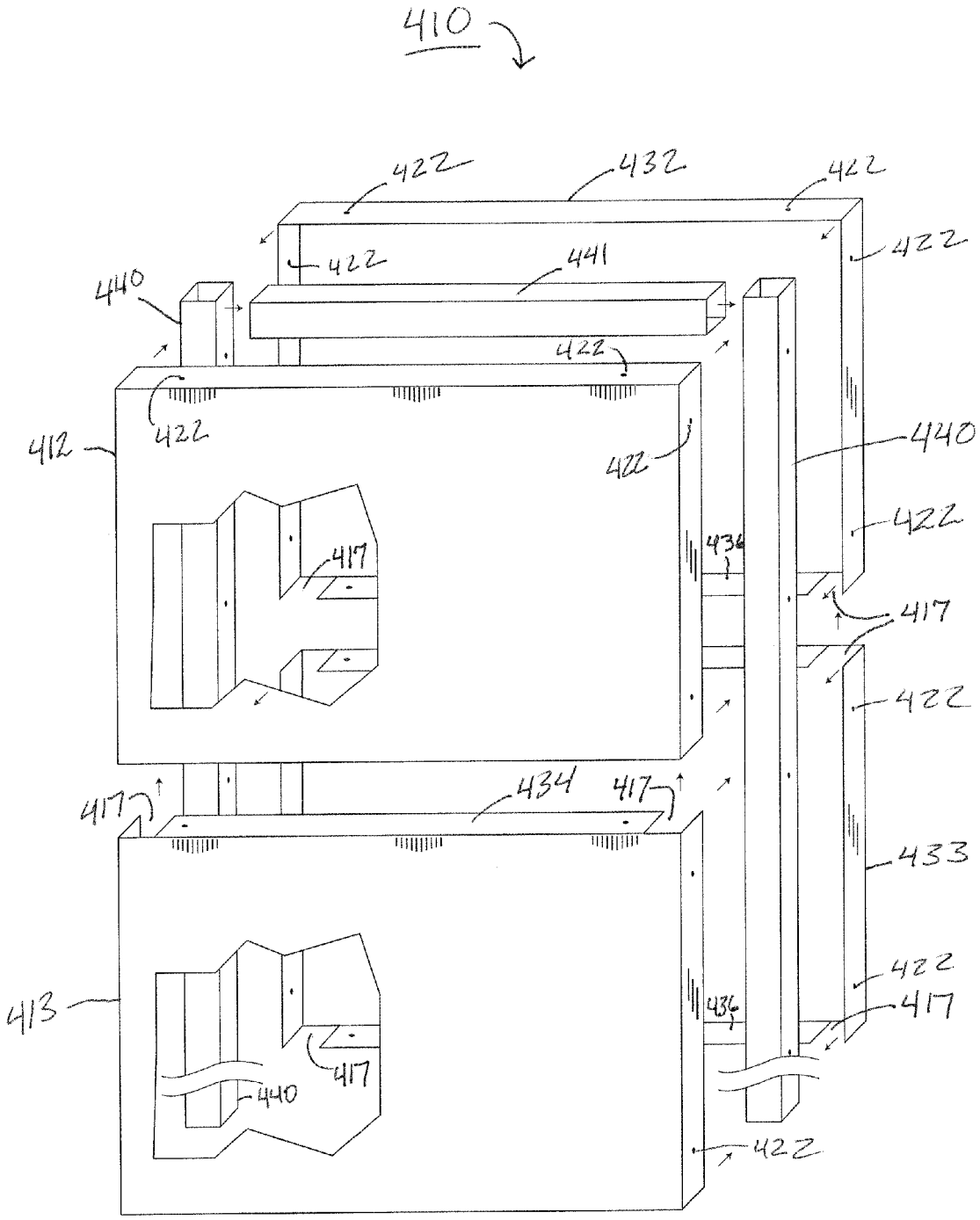
FIG. 4 is an exploded, partially cutaway, perspective view of a fourth embodiment having internal supports.

FIG. 4 depicts a modular embodiment of the invention that has internal support posts 440—i.e., at least a portion of support posts 440 are within the interior cavities of the sign modules when the sign 410 is fully assembled. Although the illustrated embodiment has two modules (412+432 and 413+433), it will be appreciated that the interior support post arrangement could be used in a sign system having only a single module.

The support structure for sign system 410 comprises vertical, generally rectangular posts 440 and cross member 441 which may have the same cross section and be fabricated from the same stock as that used for support posts 440. Cross member 441 may be secured at each end to opposing support posts 440 using conventional fastening means appropriate to the material used to fabricate post 440 and cross member 441. In the illustrated embodiment, the upper surface of cross member 441 is coplanar with the upper ends of support posts 440 when fully assembled. Additional cross members joining the two support posts 440 may be employed for added strength and rigidity. Internal diagonal bracing between the support posts may also be employed, if desired.

Front section 412 and rear section 432 are similar to front section 12 and rear section 32 of the embodiment shown in FIGS. 1 and 2. However, because the mounting posts 440 are within the interior of the assembled modules, there is no need for notches 18 in the side panels. Openings 417 in the bottom side panel 436 of top module 412/432 and in top panel 434 and bottom panel 436 of lower module 413/433 are sized and spaced to accommodate mounting posts 440 when sign 410 is assembled.

Lower module 413/433 may be positioned immediately adjacent to upper module 412/432 on support posts 440 to provide essentially contiguous surfaces (front and back) for a unitary display(s). Alternatively, the upper and lower modules may be spaced apart on support posts 440.

Sign system 410 may be assembled by enclosing the upper portions of support posts 440 in front section 412 and back section 432 of the upper module and in front section 413 and back section 433 of the lower module and inserting appropriate fasteners through holes 422. In this way, the front and back display surfaces of sign 410 remain free of fasteners and provide a flat surface(s) for receiving graphics, etc.

Figure 5:
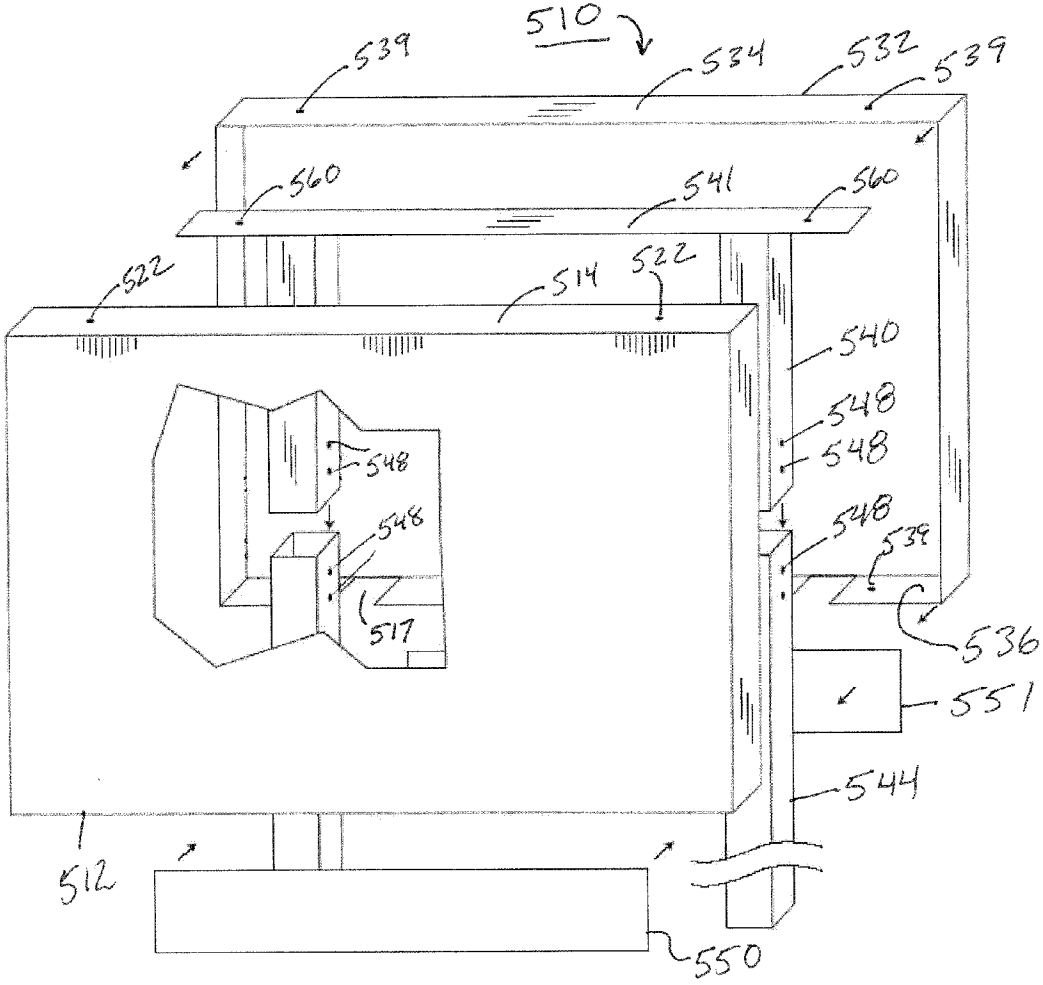
FIG. 5 is an exploded, partially cutaway, perspective view of a fifth embodiment having internal supports spaced apart from the lateral edges of the sign.

Referring now to FIG. 5, a sign system 510 according to another embodiment of the invention is shown. In this embodiment, support posts 540 are internal and spaced apart from the lateral edges of the sign module 512/532. This embodiment permits the use of a sign module whose width is greater than the distance between the support posts. In this way, a sign module of desired width greater than the support post spacing may be used with pre-existing support posts.

The support posts may comprise an upper section 540 and a lower section 544 which are joined together with fasteners which pass through connector holes 548. Top plate 541 may be attached to the upper surfaces of support posts 540 and be provided with holes 560 for receiving fasteners which pass through holes 539 in top edge 534 of rear section 532 and holes 522 in the top edge plate 514 of front section 512. Openings 517 are provided in bottom edge 536 which are sized and spaced to provide clearance for support posts 540/544. Corresponding openings may be provided in the bottom edge of front section 512 (not shown).

Auxiliary conventional signboards 550 and 551 may also be attached to support posts 540/544 below sign module 512/532. Such an arrangement may be desired in those circumstances in which a portion of a sign may require relatively frequent revision, e.g., a building directory. Another situation in which this design is particularly appropriate is when it is desired to internally light only a portion of sign system 510. Sign module 512/532 readily accommodates internal lighting means whereas conventional signboards 550 and 551 are typically externally lit (if lighted at all).

Figure 6:
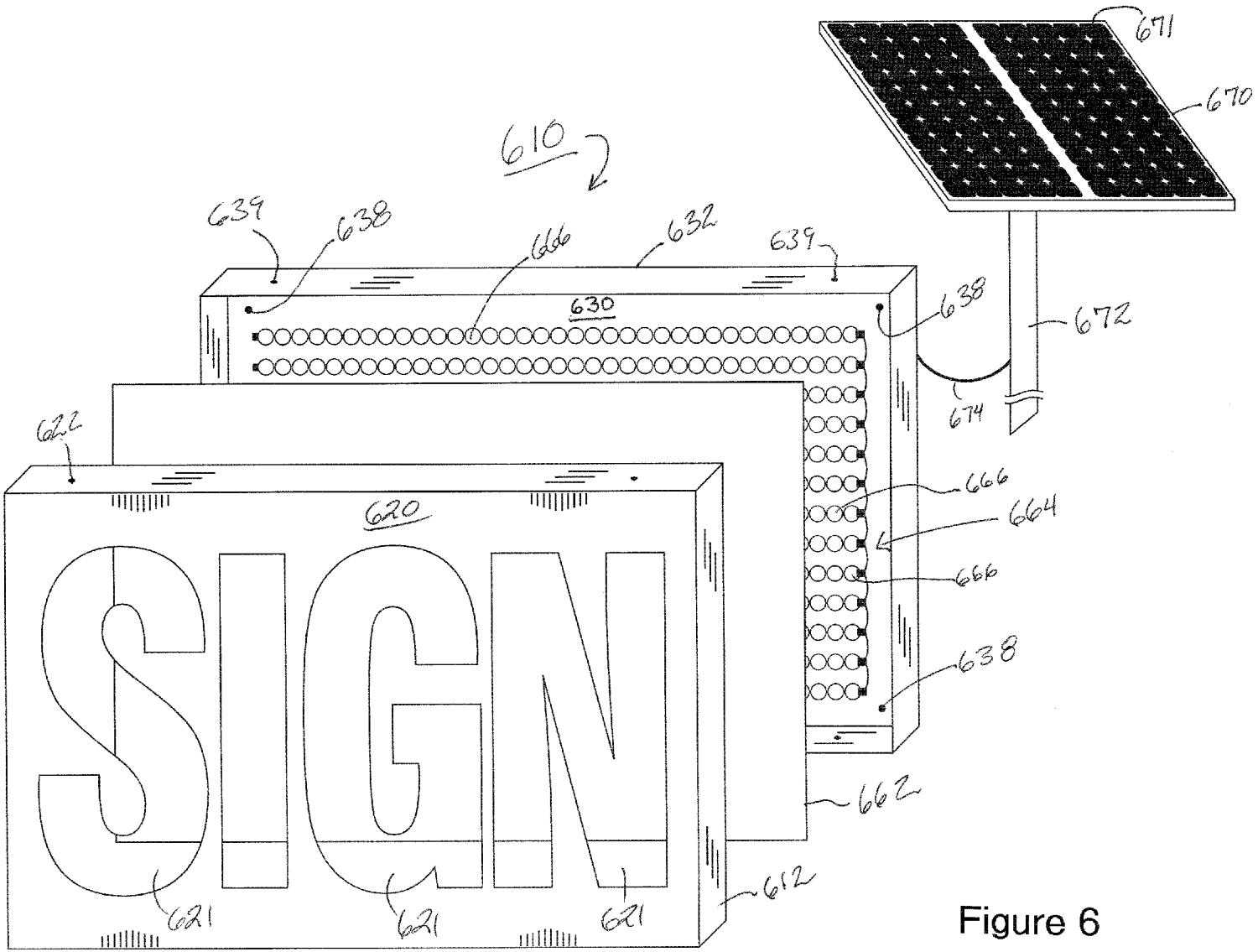
FIG. 6 is an exploded, perspective view of a sixth embodiment having solar-powered interior illumination means.

As noted above, the interior cavity created when the front and rear sections of a sign module according to the present invention are assembled provides a particularly convenient space for means for internal lighting. An example of an internally-lighted sign according to an embodiment of the present invention is shown in FIG. 6 wherein sign assembly 610 comprises a front section 612 having cutouts 621 in front surface 620. Light diffuser 662 may be sized to fit within front section 612 against the underside of surface 620.

Rear section 632 may be equipped with light array 664 comprising a plurality of light elements 666. Light elements 666 may be any known light-emitting device. Examples include incandescent bulbs, fluorescent lights, neon tubes, LED's and electroluminescent panels. The light elements 666 may be affixed to the interior surface of panel 630 or they may be suspended in the cavity. A suspended light array permits both sides of the sign module to be internally lighted.

Also shown in FIG. 6 is solar panel 670 comprising solar electric cells 671. This configuration allows the use of an internally lighted sign according to the present invention at locations lacking a conventional source of electrical power. A battery (not shown) may be charged by solar panel 670 during daylight hours and the battery may then supply power to the light array 664 at night or during any pre-selected time period. A timer and/or a light sensor may be used to control the time(s) of sign illumination. In certain embodiments, the solar panel 670 may additionally serve as the light sensor for the power controller. Solar panel 670 may be remotely mounted on mounting post 672 and connected to sign 610 via power cable 674 thereby permitting the most advantageous orientation of the solar cells 671 unconstrained by the positioning of the sign, itself.

Although the invention has been described in detail with reference to certain preferred embodiments, variations and modifications exist within the scope and spirit of the invention as described and defined in the following claims.

What is claimed is:

1. A sign comprising:

a removable, unitary front section comprised of a generally planar, polygonal front panel consisting essentially of sheet metal and a plurality of generally planar front side panels also consisting essentially of sheet metal, each front side panel contiguous with the front panel and adjacent to an edge of the front panel with each front side panel being generally orthogonal to the front panel;

a unitary rear section in sliding engagement with the front section, the rear section comprised of a generally planar, polygonal rear panel consisting essentially of sheet metal and a plurality of generally planar rear side panels also consisting essentially of sheet metal, each rear side panel contiguous with the rear panel and adjacent to an edge of the rear panel with each rear side panel being generally orthogonal to the rear panel, the rear section sized such that the side panels of the rear section fit within and adjacent to the front side panels; and, wherein the front side panels essentially completely cover the rear side panels when the front and rear sections are fully engaged.

2. A sign as recited in claim 1 wherein the front panel and the rear panel are rectangular.

3. A sign as recited in claim 2 comprising four front side panels and four rear side panels.

4. A sign as recited in claim 1 further comprising a plurality of fasteners which engage at least one front side panel and at least one rear side panel.

5. A sign as recited in claim 1 further comprising means within the rear panel for mounting the rear section to a generally planar surface.

6. A sign as recited in claim 1 wherein the front panel is devoid of fasteners.

7. A sign as recited in claim 1 wherein the front panel is a unitary, solid piece and devoid of openings.

8. A sign as recited in claim 1 wherein the front section and rear section are secured together only with fasteners which engage the side panels.

9. A sign as recited in claim 1 further comprising lettering applied to the front panel.

10. A sign as recited in claim 1 further comprising graphics applied to the front panel.

11. A sign as recited in claim 1 wherein the front section and the rear section are not connected by a hinge.

12. A modular sign comprising:

a first rear section comprised of a generally planar, polygonal first rear panel consisting essentially of sheet metal and a plurality of generally planar first rear side panels also consisting essentially of sheet metal, each first rear side panel contiguous with the first rear panel and adjacent to an edge of the first rear panel with each first rear side panel being generally orthogonal to the first rear panel;

a second rear section comprised of a generally planar, polygonal rear panel consisting essentially of sheet metal and a plurality of generally planar second rear side panels also consisting essentially of sheet metal, each second rear side panel contiguous with the second rear panel and adjacent to an edge of the second rear panel with each second rear side panel being generally orthogonal to the second rear panel, said second rear section attached to the first rear section with at least one fastener that engages a side panel of the first rear section and a side panel of the second rear section a first unitary front section in sliding engagement with the first rear section, said first front section comprised of a generally planar, polygonal front panel consisting essentially of sheet metal and a plurality of generally planar first front side panels also consisting essentially of sheet metal, each first front side panel contiguous with the first front panel and adjacent to an edge of the first front panel with each first front side panel being generally orthogonal to the first front panel, the first front section sized such that the rear side panels of the first rear section fit within and adjacent to the first front side panels and essentially completely cover the rear side panels when the front and rear sections are fully engaged; and, a second unitary front section in sliding engagement with the second rear section, said second front section comprised of a generally planar, polygonal second front panel consisting essentially of sheet metal and a plurality of generally planar second front side panels also consisting essentially of sheet metal, each second front side panel contiguous with the second front panel and adjacent to an edge of the second front panel with each second front side panel being generally orthogonal to the second front panel, the second front section sized such that the rear side panels of the second rear section fit within and adjacent to the second front side panels and essentially completely cover the rear side panels when the front and rear sections are fully engaged.

13. A method of installing a sign on a substantially planar surface comprising the steps of:

attaching a sign rear section to the planar surface, the sign rear section comprised of a generally planar, polygonal rear panel consisting essentially of sheet metal and a plurality of generally planar rear side panels also consisting essentially of sheet metal, each rear side panel contiguous with the rear panel and adjacent to an edge of the rear panel with each rear side panel being generally orthogonal to the rear panel;

sliding a removable, unitary sign front section over the sign rear section, the sign front section comprised of a generally planar, polygonal front panel consisting essentially of sheet metal and a plurality of generally planar front side panels also consisting essentially of sheet metal, each front side panel contiguous with the front panel and adjacent to an edge of the front panel with each front side panel being generally orthogonal to the front panel, the sign front section sized such that the side panels of the rear sign section fit within and adjacent to the front side panels and essentially completely cover the rear side panels when the front and rear sections are fully engaged; and, fastening the sign front section to the sign rear section with at least one fastener that engages at least one front side panel and one rear side panel.

14. A method as recited in claim 13 wherein the fasteners are sheet metal screws.

15. A method as recited in claim 13 wherein the fasteners are rivets.

16. A method as recited in claim 13 wherein attaching the sign rear section to the substantially planar surface comprises passing a fastener through a hole in the rear panel and into the substantially planar surface.

17. A method as recited in claim 13 wherein the substantially planar surface is a storefront.

18. A method as recited in claim 13 comprising installing a plurality of signs in a contiguous array.

* * * * *